US006212806B1

(12) United States Patent
Krawinkel

(10) Patent No.: US 6,212,806 B1
(45) **Date of Patent: *Apr. 10, 2001**

(54) DISPLAY APPARATUS

(76) Inventor: Karl Adolf Krawinkel, Burstenweg 49a, 51702 Bergneustadt (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/087,258

(22) Filed: May 29, 1998

(51) Int. Cl.[7] ..... G09F 3/04
(52) U.S. Cl. ..... 40/450; 340/815.62
(58) Field of Search ..... 40/450, 451; 340/815.44, 340/815.62; 345/54

(56) References Cited

U.S. PATENT DOCUMENTS

| | | | | |
|---|---|---|---|---|
| 4,024,532 | * | 5/1977 | Sherwin | 40/450 X |
| 4,070,668 | * | 1/1978 | Kawaharada et al. | 40/450 X |
| 4,117,478 | * | 9/1978 | Skrobisch | 340/815.44 |
| 4,161,832 | * | 7/1979 | Bergamini | 40/451 |
| 4,215,338 | * | 7/1980 | Selig | 340/815.62 X |
| 4,223,464 | * | 9/1980 | Winrow | 40/450 X |
| 4,383,255 | * | 5/1983 | Grandjean et al. | 340/815.62 |
| 4,542,603 | * | 9/1985 | Streeter et al. | 40/450 X |
| 4,744,163 | * | 5/1988 | Browne et al. | 40/450 X |
| 4,796,370 | * | 1/1989 | Chang | 40/450 |
| 5,388,356 | | 2/1995 | Kalivas | 40/450 |
| 5,559,528 | * | 9/1996 | Ravid et al. | 340/815.44 X |

OTHER PUBLICATIONS

Article entitled "A Sign Of Quality," *Businesss,* 1996, pp. 103 and 105.

Article entitled "PWM Keeping Pace with Technology," 1996.

Article entitled "Attractive Pricing," *Business,* Apr. 1993.

Article entitled "Die Visitenkarte Ihrer Tankstelle," *Tankstellen Markt* (including English translation).

Article entitled "Das Aushängeschild der Station mit Gesicht" (including English translation).

Article entitled "PWM—die digitale Revolution an der Station" (including English translation).

Article entitled "Herr der Preise," *Tankstelle,* Feb. 1994 (including English translation).

Article entitled "Eindrücke und Schnappschüsse von der Tankstelle '92 in Leipzig" (including English translation).

Brochure entitled "Profit today from tomorrows technology", published in 1990.

Brochure entitled "The growth of your service station", published in 1994.

Brochure entitled "The calling card for your service station", published in 1996.

Catalog entitled "PWM electronic price signs", published in 1997.

Flyer entitled "PWM Complex" (including English translation), published in 1990.

Brochure entitled "Tecnologia del mañana sus Beneficios de hoy" (including English translation), published in 1992.

Brochure entitled "Die Visitenkarte Ihrer Tankstelle" (including English translation), published in 1992.

* cited by examiner

*Primary Examiner*—Anthony Knight
*Assistant Examiner*—Vishal Patel

(57) ABSTRACT

A display apparatus includes a base member that defines a display surface and nine panel segments mounted to the base member. At least eight of the panel segments are moveable between a first position in which a panel segment lies in a general parallel and overlapping relation with the display surface and a second position. A driving assembly moves the eight panel segments between the first and second positions.

6 Claims, 4 Drawing Sheets

FIG. 4A
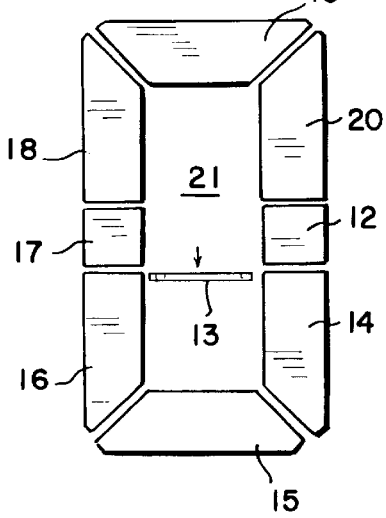
FIG. 4B
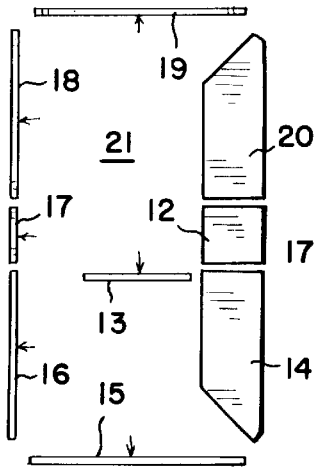
FIG. 4C
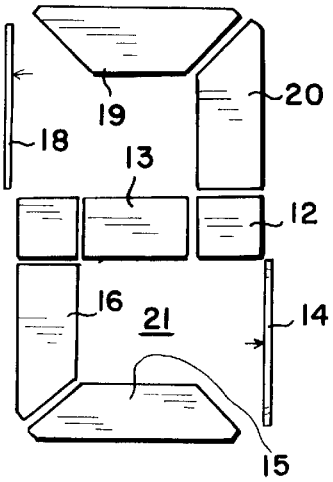
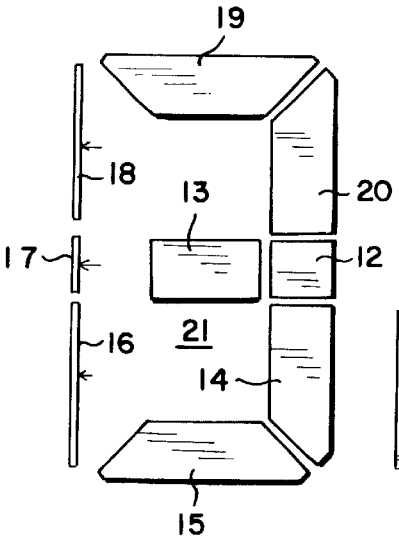
FIG. 4D
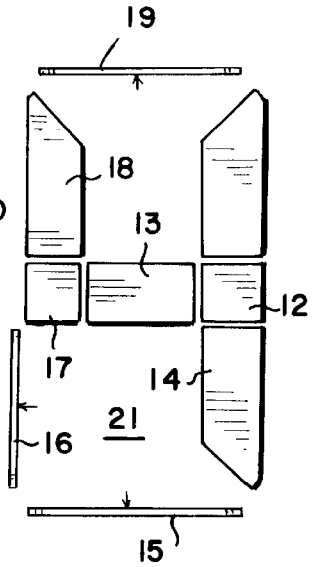
FIG. 4E
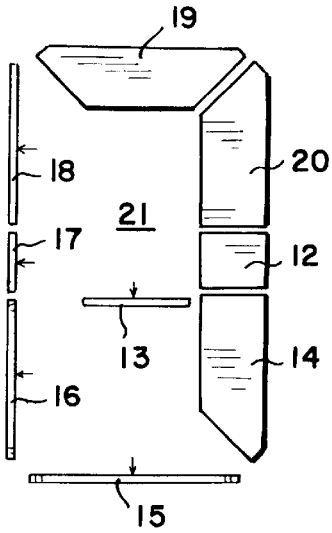
FIG. 4F
FIG. 5
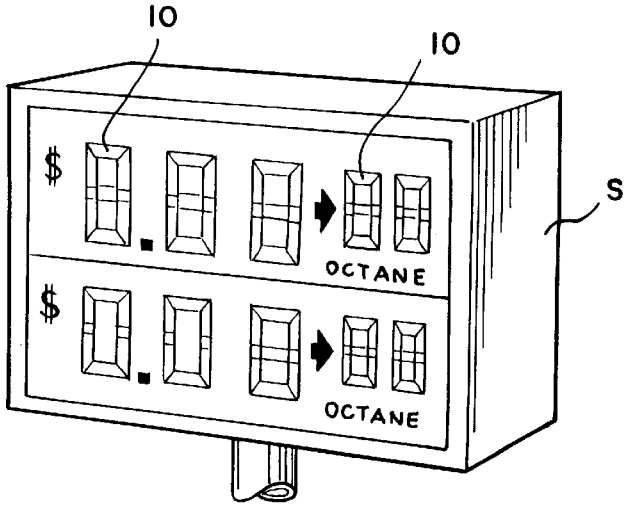

DISPLAY APPARATUS

BACKGROUND OF THE INVENTION

1. Field Of The Invention

The present invention relates to a display apparatus, and more particularly to a display apparatus with moveable panels that form selected numeric characters. Although the present invention finds utility in applications such as price signs at fuel service stations, it may operate in a large number of other applications, including those using alphabetic characters or letters.

2. Description Of The Prior Art

The prior art includes a variety of display devices, including manually operable numeric displays with interchangeable characters and automated devices that alter selected segments to form one or more numbers. For example, U.S. Pat. No. 5,388,356 that issued on Feb. 14, 1995 to Kalivas describes a changeable numeric display with seven panels that form numbers. The seven panels include four vertical panels mounted to revolve about horizontal axes and three horizontal panels mounted to revolve about vertical axes.

Like other prior display devices, however, the Kalivas sign suffers a number of disadvantages. The number of panels in the Kalivas apparatus preclude it from forming readily recognizable numbers. In addition, the method of operation of the Kalivas sign requires the display panels to project outwardly of a background surface during number changes, making the sign susceptible to wind and other forces and increasing the likelihood of malfunction.

The display apparatus of the present invention avoids the disadvantages of the prior art devices. It is a simple construction that forms highly recognizable numeric characters in an effective and consistent manner; and it minimizes the cost of fabrication and assembly.

SUMMARY OF THE INVENTION

In accordance with one embodiment of the present invention, a display apparatus includes a base member that defines a display surface and nine panel segments mounted to the base member. At least eight of the panel segments move between a first position in which a panel segment lies in a general parallel and overlapping relation with the display surface and a second portion in which the eight panel segments lie generally perpendicularly to the display surface, along edge portions of the surface.

Driving means move the eight panel segments between the first and second positions. The driving means pivots the panel segments between the first and second positions about pivot axes disposed generally parallel to edges of the display surface. One of the nine panel segments remains stationary, while one of the eight moveable segments moves through a central opening in the display surface as it pivots between its first and second positions. Alternatively, a moveable panel segment that operates in the same manner as the other moveable panel segments may replace the stationary panel segment.

BRIEF DESCRIPTION OF THE DRAWINGS

For a more complete understanding of this invention, one should now refer to the embodiment illustrated in greater detail in the accompanying drawings and described below by way of an example of the invention. In the drawings:

FIGS. 4A–4F are schematic plan views of the display apparatus, showing various numbers;

FIG. 5 is a perspective view of a service station price sign incorporating the display apparatus of the present invention.

While the following disclosure describes the invention in connection with one embodiment and modifications of that embodiment, one should understand that the invention is not limited to this embodiment and modifications. Furthermore, one should understand that the drawings are not to scale and that graphic symbols, diagrammatic representatives, and fragmentary views, in part, illustrate the embodiment. In certain instances, the disclosure may not include details which are not necessary for an understanding of the present invention such as conventional details of fabrication and assembly.

DETAILED DESCRIPTION OF THE DRAWINGS

Figure 1:
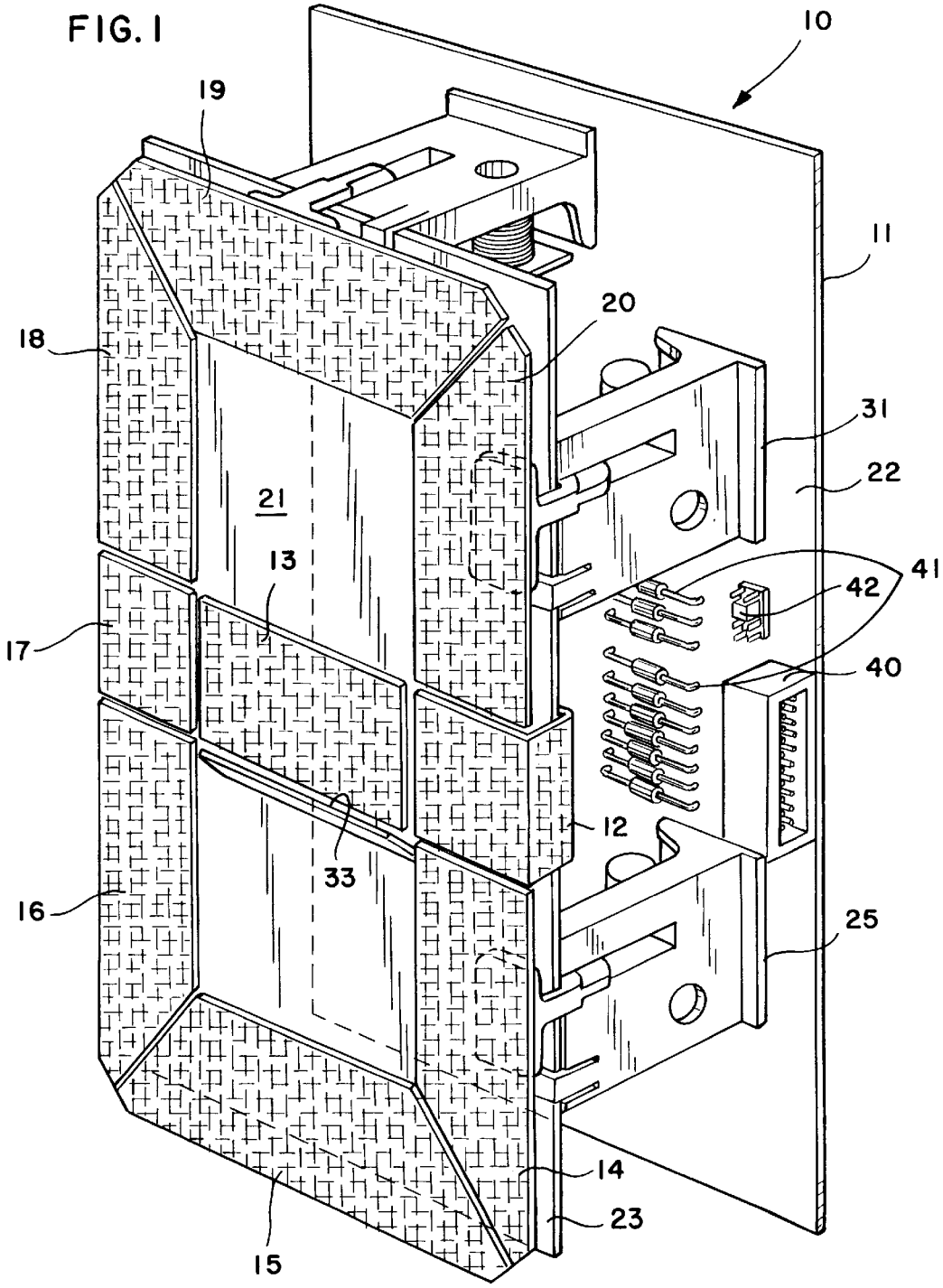
FIG. 1 is a perspective view of a display apparatus of the present invention.
Figure 2:
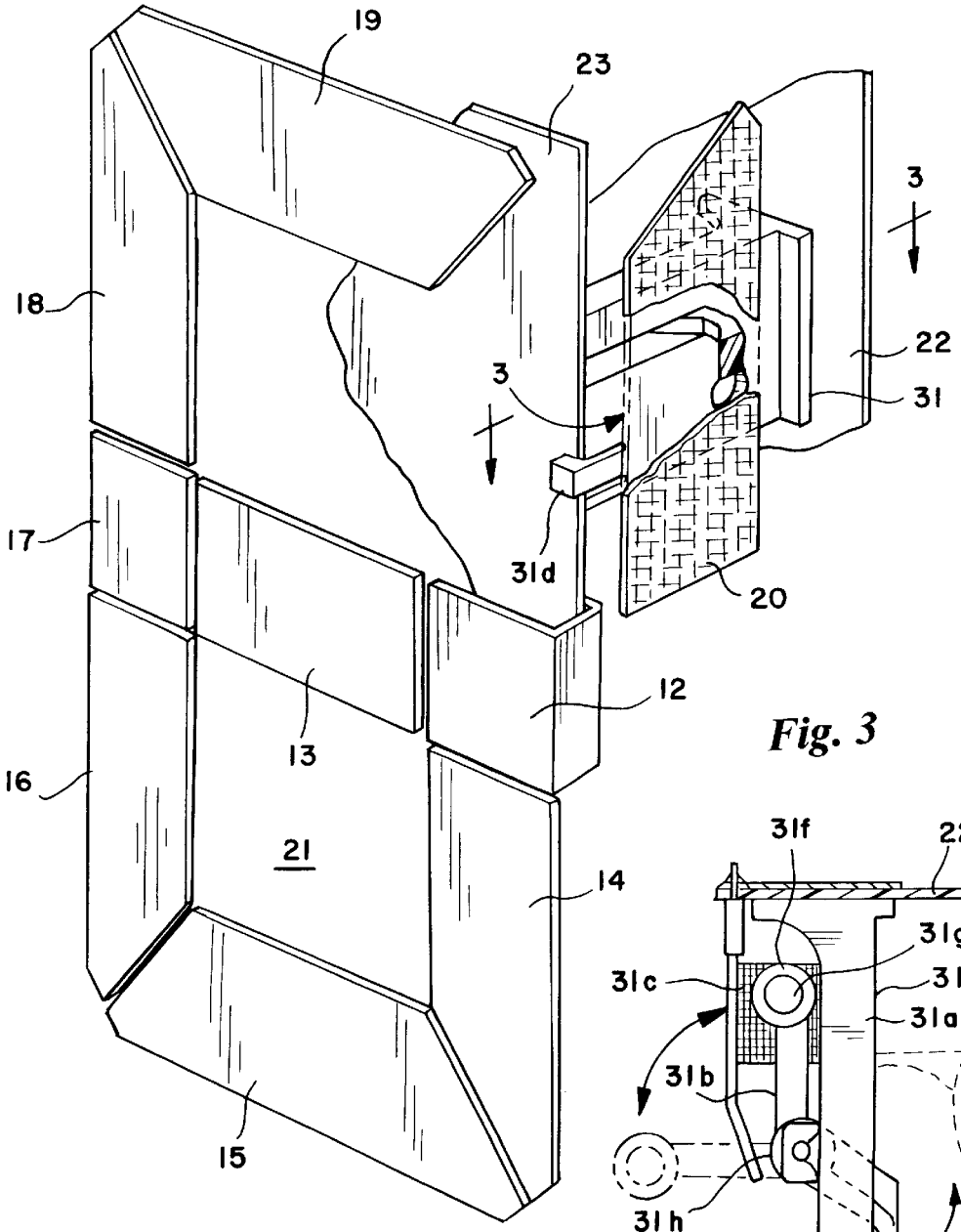
FIG. 2 is a partial perspective view of the display apparatus of the present invention with a portion of a panel segment cut away to show a drive assembly that moves the panel segment.

Turning now to the drawings and referring specifically to FIGS. 1, 2 and 5, a display apparatus 10 of the present invention generally includes a base member 11 and nine panel segments 12–20 that form selected numeric characters over a background display surface 21 of the base member 11. One or more of these apparatus may form a sign, such as the service station sign S shown in FIG. 5. This sign S includes two sets of apparatus 10, with each set comprising three large apparatus 10 to show price and two smaller apparatus 10 to show the octane of gasoline for that price. (This sign S may alternatively include permanent octane characters such as those painted onto the surface of the sign.)

The panel segments are flat, light-weight components made out of metal (e.g., aluminum), plastic or any other suitable material. The panel segment 12 remains stationary, in the position shown in FIG. 1, while the remaining eight panel segments 13–20 move between a first position shown in FIG. 1 and a second position generally perpendicularly of the display surface 11, as described in the text below. The color of the display surface 21 is significantly different than the color of the outward surface of the panel segments 12–20 (when disposed in the first position shown in FIG. 1) so that the numeric characters formed by the segments are readily recognizable from long distances.

Although the embodiment shown includes a stationary panel segment 12, this panel segment 12 may be a moveable one (like the panel segments 13–20) that operates in the same member as the panel segments 13–20. In addition and as stated above, the display apparatus 10 may include additional panel segments or repositioned panel segments that cooperate to form letters as well as numbers.

Figure 6:
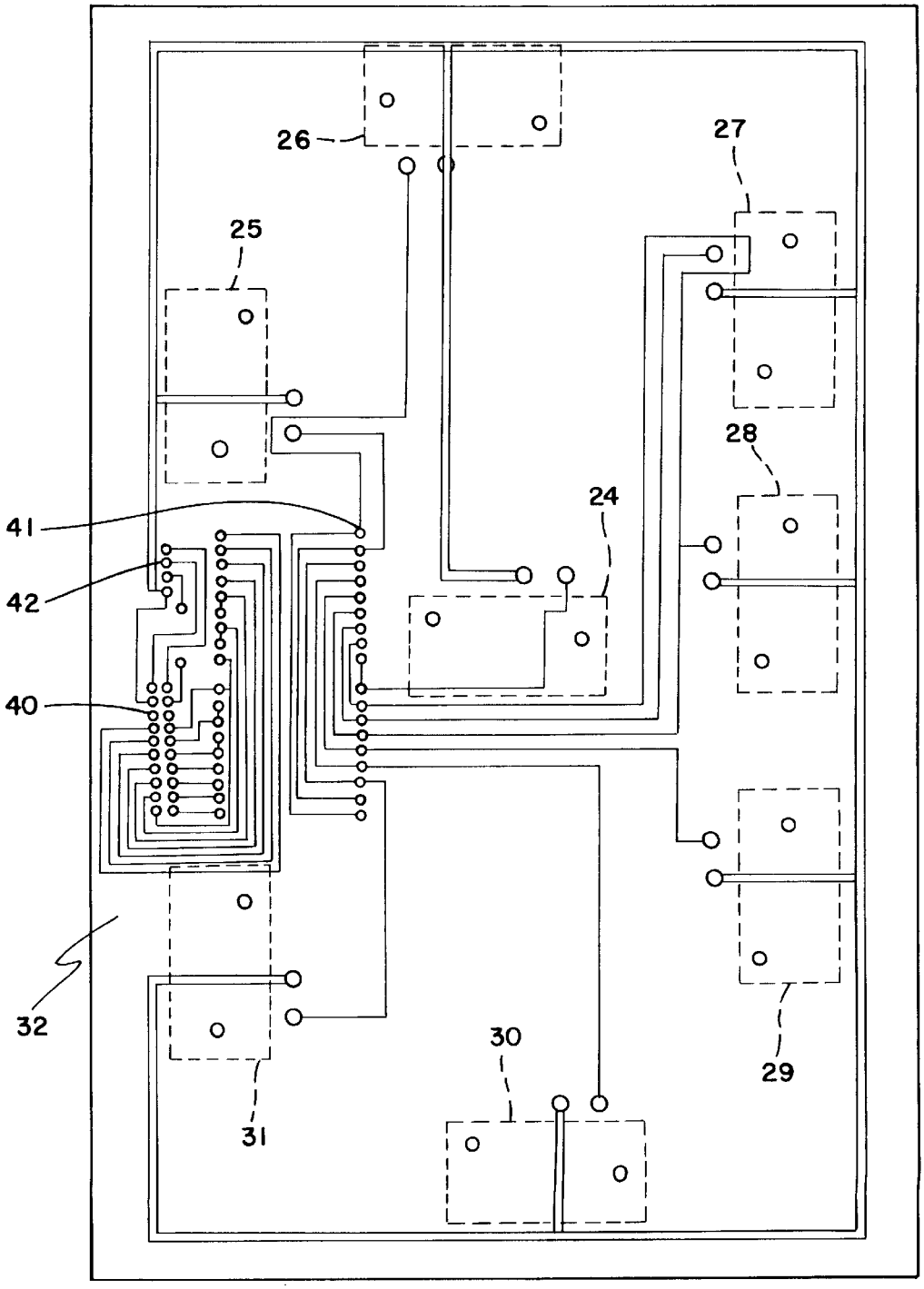
FIG. 6 is a circuit diagram of a control circuit of the display apparatus of the present invention.

The base member 11 includes a rectangular base plate 22 and a rectangular display surface plate 23 disposed in parallel, overlapping relation and spaced a predetermined distance apart by coil drive assemblies 24–31 that move the panel segments 13–20, respectively. The base plate 22 supports a control circuit 32 (See FIG. 6) which activates the drive assemblies 24–31 to selectively place the panel segments in either the first or second positions depending on the numeric character that the apparatus 10 forms. The display surface plate 23 defines the display surface 21 which serves as a background for the segments 12–20.

The base plate 22 is made of plastic material or any other suitable material typically used to encase an electronic circuit, while the display surface plate 23 is made out of metal (e.g., aluminum), plastic or any other material of sufficient strength and rigidity. The display surface plate 23 is slightly smaller than the base plate 22. Thus, when two or more of the apparatus 10 lie in abutting side-by-side relation, a gap remains between the display surface plates 23 of adjacent apparatus 10 to allow the segments to move between their first and second positions.

The display surface plate 23 includes an opening 33 at its center with edge portions of the plate surrounding the opening. The plate segment 13 extends through this opening when moving between its first and second positions. When this segment 13 moves into its second position, it lies along an edge portion of the display surface plate 23 adjacent the opening 33. When the plate segments 14–20 move into their second positions, they lie along outer edge portions of the display surface plate 23, as shown in FIGS. 4A–4F.

The coil drive assemblies 24–31 are known, conventional devices. They all have the same components; and, like all the others, assembly 31 includes a body segment 31*a*, an arm segment 31b, and a coil segment 31*c*. (See FIG. 3) One end of the body segment 31*a* lies secured (e.g., screwed or adhered) to the base plate 22, and an opposite end receives an edge portion of the display surface plate 23 as at 31*d*. The arm segment 31*b* includes an end portion 31*e* secured to the panel segment 20, an opposite end portion 31*f* with a metal insert 31*g* upon which the coil segment 31*c* acts, and a middle portion 31*h* pivotally secured to the body segment 31*a*.

Figure 3:
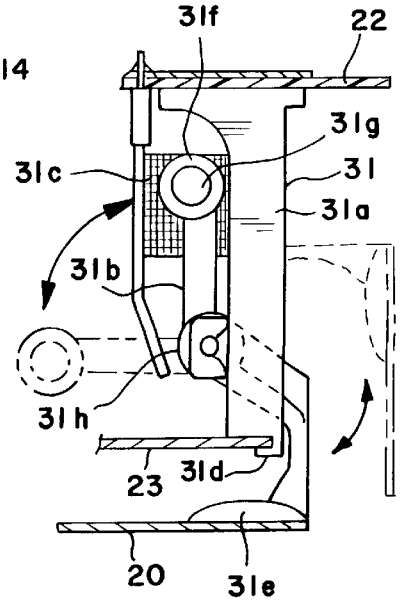
FIG. 3 is a sectional view taken along line 3—3 in FIG. 2.

The apparatus controls, including the control circuit 32, activate the coil segment 31*c* to move the arm segment 31*b* from the position shown in solid lines in FIG. 3 to the position shown in phantom lines. In this manner the controls may selectively move the panel segments 12–20 in either their first or second positions to form the numeric characters shown in FIGS. 4A–4F.

As stated above, the base plate 22 functions as a circuit board, printed with the circuit 32. It also supports a twenty pole flat cable connector 40 for connection to a control unit (not shown), which along with the coil drive assemblies 24–31 and diodes 41, seats and unseats the plate segments. A jumper 42 identifies which position in a given sign S that that particular apparatus 10 occupies. This is necessary since all the apparatus 10 have similar constructions. Alternatively, a small switch or commutator or any other similar means may perform switching or conductor selection in place of the jumper 42.

While the above description and the drawings disclose and illustrate one embodiment and various modifications, one should understand, of course, that the invention is not limited to this embodiment and modifications. Those skilled in the art to which the invention pertains may make other modifications and other embodiments employing the principles of this invention, particularly upon considering the foregoing teachings. For example, solenoids may replace the coil segments in the driving assemblies. Therefore, by the appended claims, the applicant intends to cover any modifications and other embodiments as incorporate those features which constitute the essential features of this invention.

What is claimed is:

1. A numeric display apparatus comprising: a base member with a display segment that defines a display surface and that includes linear edge portions; nine panel segments mounted to the base member, at least eight of said panel segments being moveable between a first position and a second position, each of the eight panel segments being disposed in a generally parallel, overlapping relation with the display surface when in the first position, each of the at least eight panel segments being disposed along an edge portion of the display surface when in the second position; driving means for moving the eight panel segments between the first and second positions; the nine panel segments forming the number 8 when placed in the first position; said driving means pivoting the panel segments between the first and second positions; the display segment defining an opening proximate a middle portion of the display surface, one of the at lest eight panel segments extending through the opening to move from the first to the second position.

2. The apparatus of claim 1, wherein the display segment is generally rectangular.

3. The apparatus of claim 2, wherein the driving means includes a separate electromagnetic coil for each panel segment.

4. The apparatus of claim 1, wherein the eight panel segments lie generally perpendicularly to the display surface in the second position.

5. The apparatus of claim 1, wherein the display surface has a first predetermined color and each of the panel segments has an outer surface with a second predetermined color, the first and second predetermined colors are contrasting colors.

6. A. The apparatus of claim 1, wherein one of the nine segments is stationary.

* * * * *